United States Patent [19]

Hellman et al.

[11] 4,011,108

[45] Mar. 8, 1977

[54] CUTTING TOOLS AND A PROCESS FOR THE MANUFACTURE OF SUCH TOOLS

[75] Inventors: Per Ingvar Hellman, Soderfors; Bo Gunnar Klang, Oxelosund, both of Sweden

[73] Assignee: Stora Kopparbergs Bergslags Aktiebolag, Falun, Sweden

[22] Filed: Jan. 19, 1976

[21] Appl. No.: 650,002

[52] U.S. Cl. ..... 148/11.5 P; 29/182; 75/226; 148/31

[51] Int. Cl.[2] ..... B22F 3/16; B22F 5/00

[58] Field of Search ..... 75/0.5 B, 0.5 BA, 0.5 BB, 75/0.5 BC, 0.5 C, 226; 148/31, 11.5 P; 29/182, 420.5

[56] References Cited

UNITED STATES PATENTS

| | | | |
|---|---|---|---|
| 3,485,620 | 12/1969 | Bieber et al. | 148/31 |
| 3,649,256 | 3/1972 | Fletcher | 75/0.5 BB |
| 3,649,257 | 3/1972 | Fletcher | 75/0.5 BB |
| 3,655,365 | 4/1972 | Holtz, Jr. | 148/11.5 P |
| 3,746,518 | 7/1973 | Holtz, Jr. | 75/0.5 BA |

*Primary Examiner*—W. Stallard

*Attorney, Agent, or Firm*—Curtis, Morris & Safford

[57] ABSTRACT

The invention relates to a cutting tool containing 25–33 percent by weight of Co and certain amounts of W, Mo, C, B, Zr, Si, Mn, Cr, Ni and Fe containing normal contaminants, W + 2Mo being equal to 20–40 percent by weight, the structure of the tool consisting of a martensitic matrix having a grain size of 5–70 $\mu$m, determined as austenite grain size, containing 5–15 percent by volume of an intracrystalline, very homogeneously distributed fine-disperse phase consisting of an intermetallic compound of Fe, Co, W and/or Mo and, between the grains of the base mass, 20–30 percent by volume of a primarily precipitated phase mainly consisting of the same intermetallic compound but having a predominant grain size of 1–2 $\mu$m. The invention also relates to a process of preparing such a tool by finely dividing a melt of the composition given and cooling in a non-oxidizing atmosphere to a fine powder, hot-compacting the powder to an ingot, hot-working the ingot to a blank which is allowed to cool and is possibly soft annealed, forming the blank to a tool by reductive machining, solution annealing the tool by heating to the austenitizing temperature, cooling and tempering at least once.

4 Claims, No Drawings

CUTTING TOOLS AND A PROCESS FOR THE MANUFACTURE OF SUCH TOOLS

The present invention relates to cutting tools designed in a manner well known in the art but having a certain defined metallurgical composition and structure, more particularly, the invention also covers a process of preparing tools having such composition and structure.

The above mentioned tools are primarily intended for machining of particularly hard materials which are difficult to machine, such as titanium and nickel base alloys, so-called super alloys. Machining of such materials calls for particularly great demands with regard to the hot hardness and toughness of the tools.

The general desiderata for a material intended for cutting tools is that it has sufficient hardness and toughness and also occasionally hot-hardness. Hot-hardness is measured such as by a Vickers $H_{,}5$ test. Hardness at room temperature (20 C) is measured such as by a Rockwell C test. Toughness is stated by comparative turning tests where the amount of chips from the edge of the tool are examined. Hot workability is stated by comparative forging tests in our hammer mill. Grindability is stated by determination of the worn out state of the grinding wheel when grinding different steel-qualities under the same conditions. Preferably, the material by suitable heat treatment should be softened to such an extent that the desired tool having the desired measurements can be manufactured without difficulties, the heat-treatment of the final tool being then carried out in such a manner as to impart the desired final characteristics to the tool. The final heat-treatment should be carried out in such a way that warpage or other dimensional changes of the tool do not occur.

It is previously known that certain steel alloys having a low content of C but high contents of Co, W and Mo, can be imparted a high degree of hardness by precipitation hardening and furthermore maintain the hardness to higher temperatures than conventional high speed steels. In attempting to use these steels for the preparation of cutting tools it has, however, been found that ordinary ingots of said steels become brittle and not heat-workable. In order to impart a satisfactory toughness to tools of such steels, it has been necessary to reduce the alloying contents as well as to temper the steels to such an extent that the maximum hardness of the steels could not be achieved or utilized.

The present invention relates to tools having such composition and structure as to have a sufficient toughness in spite of a high hot-hardness. The invention also covers a process of preparing such tools. A tool in accordance with the invention contains:

| | | |
|---|---|---|
| Co | 25 - 33 | percent by weight |
| W | 0 - 30 | percent by weight |
| Mo | 0 - 20 | percent by weight |
| C | 0 - 0.20 | percent by weight |
| B | 0 - 0.01 | percent by weight |
| Zr | 0 - 0.03 | percent by weight |
| Si | 0 - 1.0 | percent by weight |
| Mn | 0 - 0.4 | percent by weight |
| Cr | 0 - 0.4 | percent by weight |
| Ni | 0 - 0.4 | percent by weight |
| and Fe containing normal contaminants | | |
| and W + 2Mo being equal to 20 - 40 percent by weight. | | |

A mixture of B and Zr is also to recommend but in this case the percentage by weight of the mixture is not allowed to exceed 0.03%.

One atom of W can be changed for one atom of Mo and as the atom weight of Mo is just double the atom weight of W the percent value by weight of Mo is equal to 2 times the percent value of W.

Structurally, the tool consists of a martensitic matrix having a grain size of 5 - 70 $\mu$m, containing 5 - 15 percent by volume of any intracrystalline, very homogeneously distributed fine-disperse (<0.1 $\mu$m) phase consisting of an intermetallic compound of Fe, Co, W (one atom of W can be changed for one atom of Mo) and, between the grains of the base mass, 20 - 30 percent by volume of a primarily precipitated phase mainly consisting of the same intermetallic compound as defined above but having a predominant grain size of 1 - 2 $\mu$m. The grain sizes are determined by direct measuring the observed grains in a microscope.

The grain size of the martensitic matrix is very difficult to determine in a microscope which depends on difficulties in discerning the borders of the grains. The most common way is instead to etch in such a way that the earlier grain borders of the austenite grains become visible. It is well known that the borders of the grains in the martensite matrix are the same as in the austenite.

In accordance with this invention, the tool is manufactured by finely dividing a steel melt of the composition given and cooling the melt to a fine powder. Said powder is hot-compacted to an ingot which is hot-worked to a blank that is allowed to cool slowly, e.g. wrapped up in wermiculite, and is possibly soft annealed, e.g. for 10–15 hours at 875° - 910° C. The blank is then shaped to tools by reducive machining, the tools being solution-annealed by heating to the austenitizing temperature, e.g. 1200° - 1350° C, quenched and tempered at 550° - 700° C for 2 - 5 hours at least at once.

The contents of W (and possibly Mo, see above) in the steel are so high as to form an intermetallic compound of Fe, Co, W and Mo at an early stage, said compound being only partly dissolved in the solution annealing. This holds the grain growth and promotes the toughness and wear resistance of the steel. The carbon content should be kept as low as possible but may be allowed to increase up to 0.20 percent by weight, since the major part of C is bound as carbides which only to a minor extent are dissolved in the solution annealing and thereby is found mainly as a primarily precipitated phase dispersed in the matrix. Mn, Cr and Ni lowers the temperature for the transformation from ferrite to austenite, which lowers the hot hardness and therefore should be kept as low as possible. Individually, these should not exceed 0.4 percent by weight. B and Zr in low amounts have a favourable effect on the ductility of the steel and may suitably be added in amounts of 0.005 - 0.01 percent by weight of B or 0.005 - 0.03 percent by weight of Zr. Both B and Zr may be present simultaneously, but in this case the total amount of B + Zr is not allowed to exceed 0.03 percent by weight together.

The tools according to the invention are suitably manufactured in the following manner. A pre-alloyed melt of the composition given, having a melting point of about 1500° C, which is 250° C higher than for ordinary high speed steels is finely divided under non-oxidizing conditions and rapidly cooled to a fine powder. The atomization may for instance take place by letting the melt in a small jet flow into a closed chamber, wherein it is disintegrated by gas jets of a non-oxidizing gas, for instance nitrogen. The powder obtained suitably having a powder grain size between 100 and 400 μm is then hot-compacted to a homogeneous steel ingot. The hot-compacting which, for example, may be carried out by isostatic hot-pressing, suitably takes place at a temperature of 1200 – 1250° C. The steel ingot obtained is then worked, suitably at a temperature between 1000° and 1200° C, for instance, by rolling or forging to a suitable blank.

The blank is then allowed to cool slowly down to a temperature of at most 500° C, for instance by embedding in vermiculite. The blank is then suitably subjected to soft annealing at 875° – 910° C for 10 – 15 hours, whereafter it once more is allowed to cool slowly down to at most 700° C. The obtained blank, which in this state is usually delivered to a tool manufacturer, is then machined by methods, such as turning and grinding, to the desired shape. The tools are then solution annealed by heating to a temperature of 1200° – 1350° C, whereafter they are quenched, i.e. rapidly cooled e.g. in a salt bath.

If no further working of the tool is required, the cooling is interrupted at 250° – 350° C by quenching in a isothermal bath. The tools are then tempered by heating to 550° – 700° C for 2 to 5 hours. This annealing is repeated at least once.

If further working is required the tool is cooled from the solution annealed state down to room temperature by quenching in oil. In view of the low carbon content the martensite formed is so soft as to enable easy working of the tool. After finalized working, the tool is tempered by heating to a temperature of 550° – 700° C for 2 to 5 hours. This tempering may be repeated.

After the tempering, the tools have the structure characteristic of the invention of a martensitic matrix having an austenite grain size of 5 to 70 μm containing 5 – 15 percent by volume of an intracrystalline homogeneously divided highly fine-disperse phase less than 0.1 μm consisting of an intermetallic compound of Fe, Co and W and Mo (see above) and between the grains of the matrix 20 – 30 percent by volume of a primarily precipitated phase essentially consisting of the same inter-metallic compound but having a predominant grain size of 1 – 2 μ,m the different phases being evenly distributed across the whole tool without segregations or inhomogenities. Hereby, the final tool obtains a very high hardness (70 HRC) and a good toughness unusual of this type of steel and a very high tempering resistance and hot-hardness. The invention will in the following be illustrated by some examples.

Eight alloys were prepared having the compositions given in Table I below.

The steels were prepared in conformity with the ASEA-STORA-process resulting in 100 percent compact billets completely free from disturbing segregations.

The billets could without problems be hot-worked at a temperature of 1100° C. The alloys were tested as small blanks from the hot-worked bars. All alloys were solution-annealed at 1250° C and tempered once during a time of 2h at 600° C. After completed heat treatment, the hardness of the alloys was determined. Hot hardness curves were measured and the temperature, where the hot hardness is 500 $H_v5$, is given in the Table. By 500 $H_v5$ we mean a Vicker hardness of 500 measured with a load of 5 grams on to the pressing diamond tip.

The alloy identified as I containing B and Zr shows a ductility which far exceeds those of the alloys not containing these additives. The ninth alloy, G 51 was manufactured in a conventional manner, i.e. by casting to ordinary ingots.

TABLE 1

| Alloy (base Fe) | C % | Co % | W % | Mo % | B ppm | Zr ppm | RT-hardness $H_{RC}$ | Hot-hardness 500 $H_v5$ |
|---|---|---|---|---|---|---|---|---|
| A | 0.069 | 25.6 | 25.2 | — | — | — | 68.0 | 680° C |
| B | 0.022 | 30.0 | 20.0 | — | — | — | 67.0 | 690° C |
| C | 0.021 | 27.2 | 17.4 | 7.1 | — | — | 69.5 | 680° C |
| E | 0.069 | 27.5 | 13.6 | 6.5 | — | — | 69.0 | 680° C |
| G | 0.14 | 27.3 | 6.2 | 14.0 | — | — | 69.8 | 675° C |
| I | 0.065 | 27.0 | 13.8 | 7.3 | 80 | 100 | 69.0 | 680° C |
| X80 | 0.054 | 30 | 0.10 | 12.3 | — | — | 68.2 | 670° C |
| X51 | 0.20 | 30 | 7.3 | 7.3 | — | — | 68.2 | 640° C |
| G51. | 0.08 | 28 | 9.4 | 5.4 | — | — | 68.1 | — |

By RT-hardness $H_{RC}$ we mean the Rockwell C hardness measured at room temperature.

As an example of the higher toughness of alloys covered by the invention and prepared by the powder process described in connection with the invention, in contrast to the alloys conventionally manufactured i.e. casting to an ingot, a standardized milling test, so-called SFA-test was made. (As to SFA-test see Proceeding 3rd MTDR Conference, Birmingham Sept. 1962, Pergamon Press, London 1963 Pages 55 to 67. Standardized Milling Test by Gosta Niklasson, Metal Cutting Research Department, Svenska Flygmotor AB, Trollhattan, Sweden.)

The materials covered by the invention are per se not suited for this test, but on the other hand, the test gives a very clear indication as to differences in toughness of the materials. Two SFA-tools, one powder-metallurgically prepared X80 and one from a conventional manufactured material G51 were heat-treated to maximum hardness. We mean that this two compositions, X80 and G51, are equal, depending on that the difference in C contents has no reason and on that two parts of W by weight can be replaced by one part of Mo (see above).

At a cutting speed of 60.12 m/min a feed rate of 0.086 mm/rev and a cutting depth of 1 mm the service life of the powder-metallurgically prepared tool was 19.5 minutes, whereas the cast tool cracked. The wear of the powder-metallurgically prepared tool was very even.

Turning tests have been performed on SIS 2343 (AISI 316) an austenitic stainless steel and STORA 302 (C = 0.32%, Si = 0.3%, Mn = 0.6%, Cr = 1.4%, Mo = 0.3%, Ni = 3.3% by weight) a toughened steel. Two tools were used, X51 and ASP 30, which is a powder metallurgically manufactured high-speed steel having the following analysis in % by weight: C 1.20, Cr 4.2, Mo 5.0, W 6.4, Co 10.0, V 3.4, and the remainder Fe. The tools were heat-treated to maximum hardness as in Table II.

TABLE 2

| | | |
|---|---|---|
| X 51 | Hardening 1250° C | tempering once during 2 hours at 600° C |
| ASP 30 | Hardening 1220° C | tempering 3 times during 1 hour at 560° C |

Table 3 below shows the service life (in minutes) for the different tools on the different workpieces.

TABLE III

| Work Piece: | | SIS 2343 | STORA 302 |
|---|---|---|---|
| Cutting date: | Cutting speed | 25 m/min | 25 m/min |
| | Reed rate | 0.32 mm | 0.33 mm |
| | Cutting depth | 2 mm | 2 mm |
| Service Life: | | | |
| Tool: X51 | | 106 min | 71 min |
| ASP 30 | | 30 min | 30.5 min |

As is seen from the Table above, tools of materials covered by the invention are superior to high-speed steel tools.

What is claimed is:

1. Cutting tool containing

| | | | |
|---|---|---|---|
| Co | 25 – | 33 | percent by weight |
| W | 0 – | 30 | percent by weight |
| Mo | 0 – | 20 | percent by weight |
| C | 0 – | 0.20 | percent by weight |
| Si | 0 – | 1.0 | percent by weight |
| Mn | 0 – | 0.4 | percent by weight |
| Cr | 0 – | 0.4 | percent by weight |

-continued

| | | | |
|---|---|---|---|
| Ni | 0 – | 0.4 | percent by weight |

and the balance Fe containing normal contaminants and where W + 2Mo being equal to 20 – 40% by weight, characterized by also containing 0.005 – 0.01% B or 0.005 – 0.03% by weight Zr or a mixture of both not exceeding 0.03% by weight, the structure of the tool consisting of a martensitic matrix having a grain size of 5 – 70 $\mu$,m determined as austenite grain size, containing 5 – 15 percent by volume of an intracrystalline, very homogeneously distributed fine-disperse phase consisting of an intermetallic compound of Fe, Co, W and Mo and, between the grains of the base mass, 20 – 30 percent by volume of a primarily precipitated phase mainly consisting of the same intermetallic compound having a predominant grain size of 1 – 2 $\mu$.m 2. A process of manufacturing a tool according to claim 1 comprising the steps: finely dividing a melt of the composition defined in claim 1 and cooling in a non-oxidizing atmosphere to a fine powder having a predominant grain size of 100 – 400 $\mu$m hot-compacting the powder by isostatic hot-pressing at 1200° – 1250° C to a billet, hot-working the billet at a temperature of 1000° – 1200° C to a blank which is allowed to cool, soft-annealing the blank at 875° – 910° C for 10 – 15 hours followed by cooling, forming the blank to a tool by reduction machining, solution annealing the tool by heating to an austenitizing temperature of 1200° – 1350° C cooling and tempering at least once.

3. A process according to claim 2, characterized by cooling the tool from the austenitizing temperature to 250° – 350° C and then tempering at 550° – 700° C for 2 – 5 hours.

4. A process according to claim 2, characterized by cooling the tool from the austenitizing temperature to room temperature, final working and tempering at 550° – 700° C for 2 – 5 hours at least once.

* * * * *